US010994912B2

(12) United States Patent
Johnson

(10) Patent No.: US 10,994,912 B2
(45) Date of Patent: May 4, 2021

(54) SPOUT-CONNECTOR ASSEMBLY (ECHO)

(71) Applicant: Liqui-Box Corporation, Richmond, VA (US)

(72) Inventor: James W. Johnson, Delaware, OH (US)

(73) Assignee: Liqui-Box Corporation, Richmond, VA (US)

( * ) Notice: Subject to any disclaimer, the term of this patent is extended or adjusted under 35 U.S.C. 154(b) by 58 days.

(21) Appl. No.: 16/516,863

(22) Filed: Jul. 19, 2019

(65) Prior Publication Data

US 2020/0024048 A1 Jan. 23, 2020

Related U.S. Application Data

(60) Provisional application No. 62/781,866, filed on Dec. 19, 2018, provisional application No. 62/701,143, filed on Jul. 20, 2018.

(51) Int. Cl.
*B65D 77/06* (2006.01)
*B65B 3/04* (2006.01)

(52) U.S. Cl.
CPC ..... *B65D 77/065* (2013.01); *B65B 3/04* (2013.01)

(58) Field of Classification Search
CPC ..... B65D 77/065; B65B 3/04
See application file for complete search history.

(56) References Cited

U.S. PATENT DOCUMENTS 4,421,146 A 12/1983 Bond et al.
4,445,551 A 5/1984 Bond et al.
5,031,662 A 7/1991 Roethel
5,095,962 A 3/1992 Lloyd-Davies et al.
5,680,970 A 10/1997 Smith et al.
5,697,410 A 12/1997 Rutter et al.
5,901,761 A 5/1999 Rutter et al.
5,983,964 A 11/1999 Zielinksi et al.
6,347,785 B1 * 2/2002 Copp ..... B67D 1/0835 251/149.6
6,779,556 B2 8/2004 Roethel
(Continued)

FOREIGN PATENT DOCUMENTS

KR 1020140124900 A 10/2014
WO WO 2004/085283 A1 10/2004
WO 2011/008829 A2 1/2011

OTHER PUBLICATIONS

PCT, Notification Concerning Transmittal of International Preliminary Report on Patentability, dated Feb. 4, 2021, Application No. PCT/US2019/042570, 11 pages.

*Primary Examiner* — Timothy L Maust
(74) *Attorney, Agent, or Firm* — McAndrews, Held & Malloy, Ltd.

(57) ABSTRACT

Disclosed are devices and methods for dispensing flowable material. A dispensing assembly may include a spout defining an internal surface and a passage therethrough, the spout having a first receptacle defined on the interior surface; a first slider insertable into the spout, the first slider having an external surface that defines a first locking ridge configured to releasably engage with the first receptacle; and a second slider insertable into the first slider. The first slider may be configured to move within the spout and be configured to have a first configuration and a second configuration different from the first configuration.

11 Claims, 15 Drawing Sheets

(56) References Cited

U.S. PATENT DOCUMENTS

| | | | | |
|---|---|---|---|---|
| 6,953,070 | B1 | 10/2005 | Labinski et al. | |
| 7,487,951 | B2 * | 2/2009 | Johnson | B65D 77/067 251/149.1 |
| 8,196,621 | B2 * | 6/2012 | Johnson | B67D 3/04 141/372 |
| 8,490,840 | B2 * | 7/2013 | Crossdale | F16L 37/32 222/501 |
| 9,511,907 | B2 * | 12/2016 | Erickson | B65D 47/123 |
| 9,714,124 | B2 * | 7/2017 | Johnson | B65D 47/283 |
| 10,759,583 | B2 * | 9/2020 | Johnson | B65D 25/48 |
| 2002/0079704 | A1 | 6/2002 | Rutter et al. | |
| 2002/0179875 | A1 * | 12/2002 | Davis | F16L 37/32 251/149.6 |
| 2008/0053568 | A1 | 3/2008 | Johnson | |
| 2009/0039180 | A1 * | 2/2009 | Lukasiewicz | B05B 7/0475 239/418 |
| 2010/0176151 | A1 | 7/2010 | Johnson | |
| 2015/0001261 | A1 | 1/2015 | Johnson | |

* cited by examiner

SPOUT-CONNECTOR ASSEMBLY (ECHO)

CROSS REFERENCE TO RELATED APPLICATIONS

This application claims the benefit of U.S. Provisional Application No. 62/701,143, filed Jul. 20, 2018, and U.S. Provisional Application No. 62/781,866, filed Dec. 19, 2018, the entireties of which are incorporated herein for any and all purposes.

TECHNICAL FIELD

The present disclosure is directed to a fitment for dispensing liquids and semi-liquids from a container, and more particularly relates to a fitment connector assembly for use in a quick-disconnect coupling and valve assembly.

BACKGROUND

Many systems are used for dispensing beverage syrup from a disposable package consisting of a flexible collapsible bag in a corrugated box commonly referred to as a bag-in-box dispensing package.

Generally, these systems include a bag that is provided with a fitment in the form of a spout through which filling and dispensing occurs. It is generally desirable to provide a quick-disconnect coupling between the spout and the service line of the pump or other type of beverage mixing and dispensing system. Such a coupling may be carried on the spout fitment of the bag and will work in conjunction with the service line connector or "probe", and is commonly called in the art a single-service valve and coupling since it is discarded with the bag when it is emptied. This type of valve opens automatically as the line connector is connected to the spout and closes as it is disconnected therefrom to prevent syrup from draining from the bag.

Quick-connect valve systems and slider fitments for fluid dispensing are known. Certain fitments having valves having more than one moveable component are also known.

Some systems are dedicated to only one type of currently known service line connection; while others are adapted to be used with various types of service line connectors.

U.S. Pat. No. 4,445,551 (Bond, et al.) teaches a cylindrical tubular valve member having a closed lower end positioned within a spout. Gripping lugs on the valve member are adapted to grip the dispensing connector. For dispensing, the dispensing connector pushes the valve member inwardly so that outlets on the side thereof are open to fluid flow. A seal is produced between the O-ring on the dispensing connector and the valve body. In Bond et al., a connector is disclosed that slides into a slidable valve contained within a spout. The slidable valve has fingers that fit into the connector, so that sliding the connector into the spout causes the slidable valve to grip the connector and slide into a position in the spout where the slidable valve is opened. The alignment of the connector with the slider valve is crucial to the operation of this invention, and somewhat problematic with this configuration.

U.S. Pat. No. 4,421,146 (Bond and Ulm) teaches a dispensing valve assembly for coupling to a service line connector. The valve member has gripping members that cooperate with the dispensing connector to move the valve between a closed and open position. The dispensing connector also has a collar for gripping the spout. An O-ring on the dispensing connector provides a seal with the valve.

U.S. Pat. No. 6,347,785 (Copp, et al.) discloses a universal quick-disconnect coupling and valve. The fitment includes a generally cylindrical spout for attachment to a container that is capable of mating with a dispensing connector. A slider moves axially within the spout and has a valve within it that moves from a closed position to an open position upon insertion of a dispensing connector into the slider. An external support member and clamp about the dispensing connector has teeth to engage the flange of an external adapter ring of the spout. The dispensing connector is sealed within the slider by an O-ring which cooperates with an internal adapter sleeve that fits within the slider.

U.S. Pat. No. 5,031,662 (Roethel #1), U.S. Pat. No. 6,779,556 (Roethel #2) and U.S. Pat. No. 6,953,070 (Labinski, et al.) teach a dispensing fitment having a first body secured to a liquid container and forming a first flow passage and a valve assembly connected to this secured body, which has a seal retaining body defining a second flow passage that communicates with an inlet of the first flow passage. A resilient seal member located in the second flow passage is resiliently urged into sealing engagement with the inlet to block fluid flow from the second flow passage into the first flow passage. The assembly further includes a spout that is slideable within the first body to an inward position where the seal member is moved resiliently away from the inlet to allow fluid flow between the passages. The seal retaining body is a resilient tubular member transverse to the first flow passage and is made of a resilient (i.e. rubber) material. A dispensing connector collar has grooves for engaging flanges on the first body. The dispensing connector includes O-rings for sealingly engaging the valve assembly.

U.S. Pat. No. 5,983,964 (Zielinksi, et al.) teaches a dispensing apparatus for coupling between a dispensing connector and the spout of a container so as to permit coupling of a valve sub-assembly housed in the dispensing connector with a single slider valve assembly housed in the spout. The apparatus includes a collar about the dispensing connector and includes sleeves having at least two resilient fingers members. Each finger member has a surface engageable with a flange portion on the outer surface of the spout. A collar is releasably slid over an outer surface of the sleeve for constricting the resilient finger members toward a lower end of the sleeve. The fingers act to lock the collar relative to the spout. The system provides a single-handed coupling operation for the collar and spout. An O-ring on the probe forms the seal with the valve assembly and an inner O-ring connects with the valve sub-assembly. The collar does not engage the valve assembly housed in the spout. Zielinksi discloses a valve subassembly for connecting to a line and a mating spout that contains a mechanism for actuating the valve subassembly. In that patent, the valve subassembly is described for use in conjunction with an axially engaged connector and was designed for compatibility with existing bag-in-box connectors.

U.S. Pat. No. 5,095,962 (Lloyd-Davies, et al.) teaches a fluid dispensing device comprising a valve member slideable in the spout of a container. The single valve member is tubular and has an open outer end for receiving a dispensing connector and a closed inner end. The valve member has openings through its sidewalls. In the closed position of the valve member, opposed shoulders of the valve member and of the spout resist axial movement of the valve member in either direction and interengaged sealing surfaces block fluid flow to the openings. The outer end portion of the valve member is laterally outwardly deflectable and includes protrusions adapted to enter the recess of a dispensing connector and engage the dispensing connector whereby the valve member can be moved between the open and closed position. In the dispense position, an O-ring provides a seal between the outside of the dispensing connector and the inner wall of the valve member. Lloyd-Davies discloses a connector valve that has a nut rotatably connected to it, the mating and valve actuating occurring when the spout and nut threads are engaged. The incorporation of threaded spouts presents a problem in achieving compatibility between different bag-in-box connector systems. The use of a complete thread form also can require multiple turns for making a connection and involves using longer spout. These are disadvantages for systems located in small spaces since more room is required to operate the spout and it may also be difficult to load or remove the boxes.

U.S. Pat. No. 5,697,410 (Rutter et al. #1) and U.S. Pat. No. 5,901,761 (Rutter, et al. #2) teach a spout fitment for a liquid container. The fitment includes a dispensing valve member slideable within the spout of the container. A valve element within the slideable dispensing valve member is resiliently biased to close a fluid flow opening therein. The valve element sits on the inside of a wall extending across the slideable dispensing valve member and a resilient member is required to push the valve element against the inner surface of this wall. Given this arrangement, a snap fit of parts is not possible. In the dispensing position, an O-ring on the dispensing connector forms a seal with the slideable dispensing valve member. The member may also include a ridge for engaging the O-ring and snapping into an associated groove on the dispensing connector. In some embodiments, a ridge on a dispensing connector shown can apparently press down on the top edge of the slideable dispensing valve member.

The ITW New Zealand Corporation produces a screw on connector comprising a line connector and spout assembly (part number 390-0267) that incorporates partial threads on the spout for connecting with a threaded line connector. The ITW connector incorporates two rigid partial threads on the spout for mating with a threaded line connector, thus allowing for some amount of compatibility. The ITW connector further has a self-locking feature that incorporates a notch on the spout and a mating piece on the line connector that fits into the notch to form a detent. As with the Lloyd-Davies connector, placing a rigid thread on the spout provides compatibility with other connectors difficult.

U.S. Pat. No. 5,680,970 (Smith and Tschanen) teach a self-closing dispensing valve comprising a valve housing having a fluid conduit with a valve orifice therethrough and a flow control member within the valve body. The flow control member is displaceable between a closed and open position. A plurality of resilient flexible fingers are fixed to either the valve housing or the valve member and are deflected when the valve member is displaced to its open position. The fingers are deflected by a conical camming surface on the valve member when displaced toward the open position.

International Patent Application Publication No. WO 2004/085283 (Johnson) teaches a double slider valve fitment for attachment to a container for fluid. The fitment includes a spout having an external surface capable of mating with a collar of a dispensing connector. An external slider is movable axially within the spout and an internal slider is movable axially within the external slider. The internal slider is movable between a closed position that prevents the flow of fluid through the fitment and an open position that allows for the flow of fluid through the fitment. The internal slider is adapted to be moved between the closed and open positions by insertion of the dispensing connector into the external slider. The internal slider is biased toward the closed position when the dispensing connector is released as a result of temporary deformation of portions of the external slider by the internal slider pressed inwardly by the dispensing connector. The internal slider cooperates with the dispensing connector by means of locking lugs on a top edge thereof. A dispensing connector collar is disclosed, which may be threaded for threaded engagement with an external surface of the spout. In the dispensing position, O-rings on the dispensing connector sealingly engage with the external and internal slider.

Johnson represents a significant improvement in the art. In particular, due to the arrangement of parts, a component that has a significant inherent resilience (i.e. rubber or a spring) is not required; rather the entire fitment is preferably formed of plastic. Further, the relatively simple arrangement of parts facilitates both manufacture of the individual valve components and the assembly of the fitment. There nevertheless remains room in the art for improvement. For example, in the dispensing position, sealing engagement between the dispensing connector and fitment is provided by the O-ring on the dispensing connector.

Known fitments generally seal as a result of rubber O-rings positioned on the probe. This arrangement of parts, even where another sealing position is used, can suffer from leakage and failure.

Where a collar is used, the fitments of the prior art generally engage with a dispensing connector via a gripping collar on the outside of the spout. Typically, the dispensing connector could comprise a collar adapted for threadable engagement with a flanged or threaded outside surface of the spout. The collar is typically adapted to work with certain spouts.

Known fitments further have a tendency for the collar and probe to become inadvertently disengaged, which is very inconvenient to the user.

The present invention provides a fitment that is functionally compatible with the quick connect-disconnect connector or the screw-on connector. This eliminates the need to have different dispensing connectors for different packaging fitments.

SUMMARY

The foregoing needs are met by the various aspects of spout connector assemblies and methods of dispensing disclosed. According to an aspect of the disclosure, a dispensing assembly includes a spout defining an internal surface and a passage therethrough, the spout having a first receptacle defined on the interior surface; a first slider insertable into the spout, the first slider having an external surface that defines a first locking ridge configured to releasably engage with the first receptacle; and a second slider insertable into the first slider. The first slider is configured to move within the spout and is configured to have a first configuration and a second configuration different from the first configuration.

According to another aspect, a method of filling a container with a flowable material includes the step of providing a container having a spout fixedly attached thereto, the spout defining a passage therein that is in fluid communication with the container, the passage having therein a first slider and a second slider within the first slider, the first and second sliders being disposed in a first position within the passage. The method further includes the steps of removing the first slider and the second slider out of the passage, introducing the flowable material into the passage through the spout such that the flowable material enters the container, and reintroducing the first slider and the second slider into the passage, such that the first and second sliders are disposed in a second position within the passage that is different from the first position.

According to another aspect, a method of dispensing a flowable material through a dispensing assembly having a spout defining a passage therethrough, a first slider disposed in the passage, and a second slider disposed in the first slider is disclosed. The method includes providing the spout fixedly attached to, and in fluid communication with, a container having the flowable material therein, inserting a dispensing connector into the spout, such that the dispensing connector contacts the second slider, and moving the second slider from a closed position, in which the flowable material is precluded from passing therethrough, to an open position, in which the flowable material is permitted to pass therethrough.

According to another aspect, a dispensing system for dispensing flowable material includes a spout defining an internal surface and a passage therethrough, a first slider, a second slider, and a dispensing connector. The spout has a first receptacle defined on the interior surface and a second receptacle defined on the interior surface spaced away from the first receptacle. The first slider is insertable into the spout and has an external surface that defines a first locking ridge configured to releasably engage with the first receptacle and a second locking ridge configured to engage with the second receptacle. The second slider is insertable into the first slider and is movable between a closed position operable to prevent the flowable material from passing through the dispensing assembly and an open position operable to allow the flowable material to pass through the dispensing assembly. The dispensing connector is configured to releasably engage with the second slider and to move the second slider from the closed position to the open position. The first slider is configured to move within the spout and is configured to have a first configuration and a second configuration different from the first configuration According to another aspect, a fitment assembly for use with a quick-connect-disconnect dispensing connector or a screw-on connector includes a fitment for attachment to a container for holding and dispensing a fluid. The fitment includes (i) a generally cylindrical spout attached to the fitment, (ii) a generally cylindrical external valve body, and (iii) a generally cylindrical internal valve body. The spout includes a base portion attachable to said container and a top portion suitable for receiving a dispensing connector, the generally cylindrical spout defining an interior surface and having a top receptacle and a bottom receptacle on the interior surface. The generally cylindrical external valve body is movable to a first position within the spout and a second position within the spout, the first position being different from the second position. The external valve body includes a top end and a bottom end, wherein said external valve body has a plurality of circumferentially located flexible tabs at the top end of said external valve body. The top end engages a dispensing connector, the generally cylindrical external valve body further having a locking ridge. The generally cylindrical internal valve body is movable axially within the external valve body. The internal valve body is movable between a closed position operable to prevent the flow of fluid through the fitment and an open position operable to allow the flow of fluid through the fitment. The internal valve body is movable between closed and open positions by insertion of a dispensing connector into the external valve body adjacent the internal valve body, the internal valve body being biased toward the closed position.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. In the drawings.

Aspects of the disclosure will now be described in detail with reference to the drawings, wherein like reference numbers refer to like elements throughout, unless specified otherwise.

DETAILED DESCRIPTION OF ILLUSTRATIVE EMBODIMENTS

Figure 1:
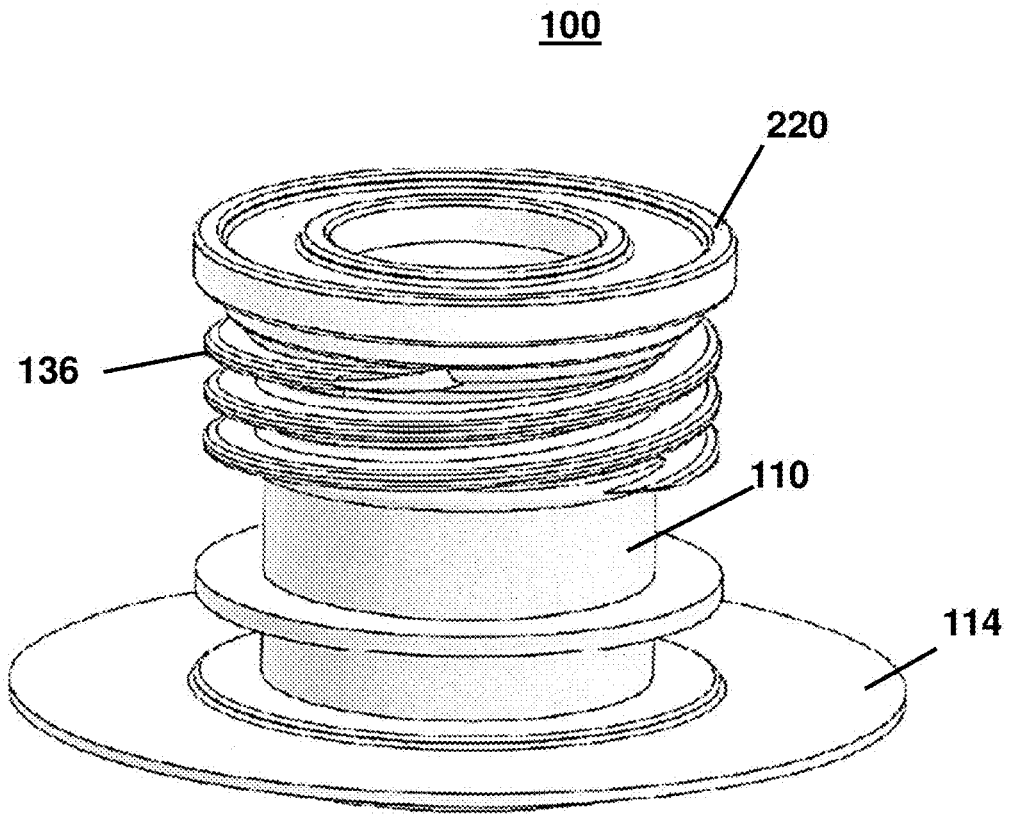
FIG. 1 illustrates an isometric view of a spout assembly according to an aspect of this disclosure.
Figure 2:
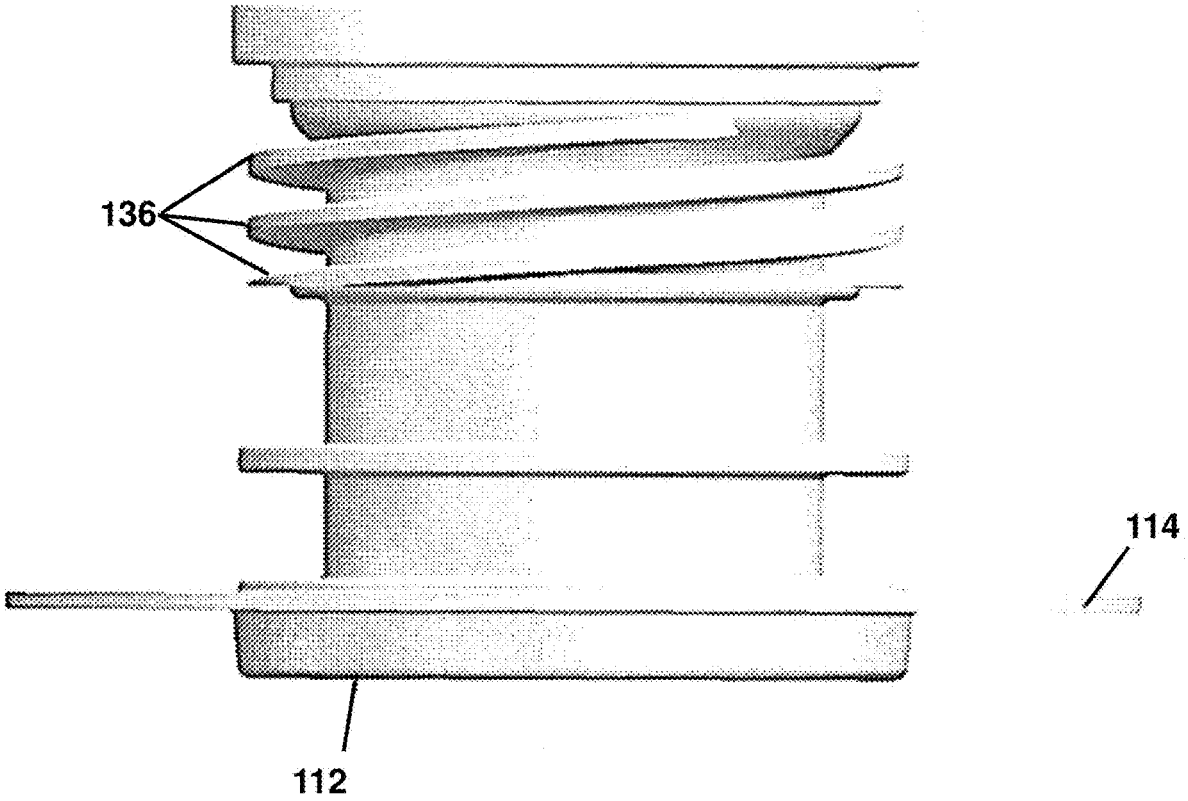
FIG. 2 illustrates a front perspective view of the spout assembly of FIG. 1.
Figure 3:
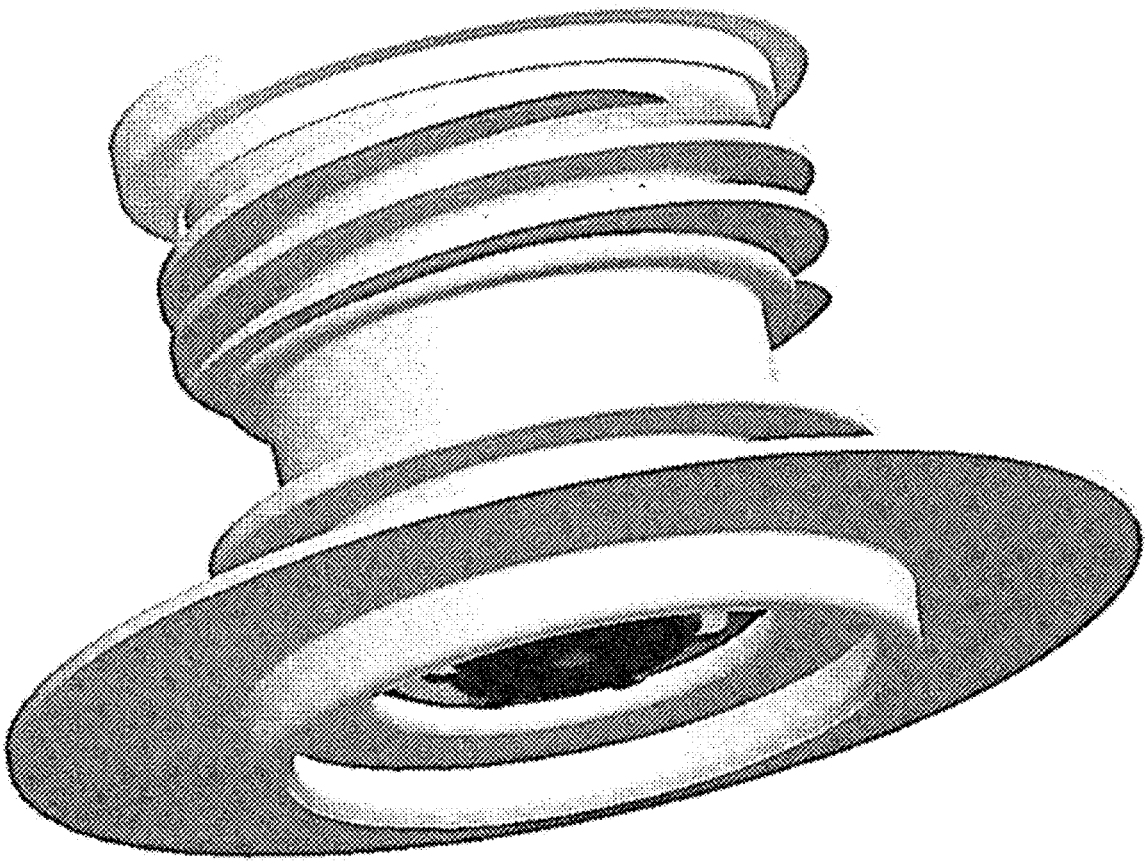
FIG. 3 illustrates another isometric view of the spout assembly of FIGS. 1 and 2.
Figure 4:
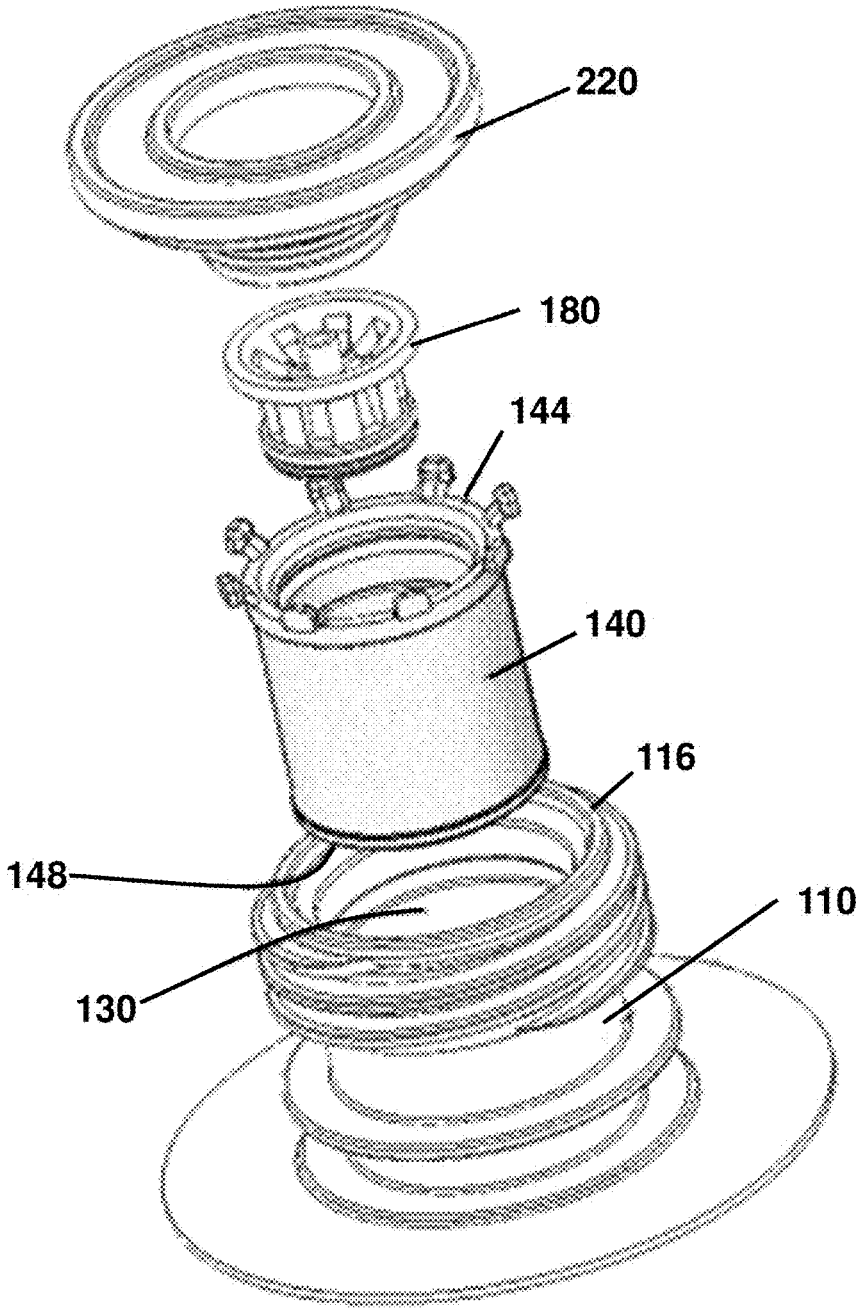
FIG. 4 illustrates an exploded isometric view of the spout assembly of FIGS. 1-3.
Figure 5:
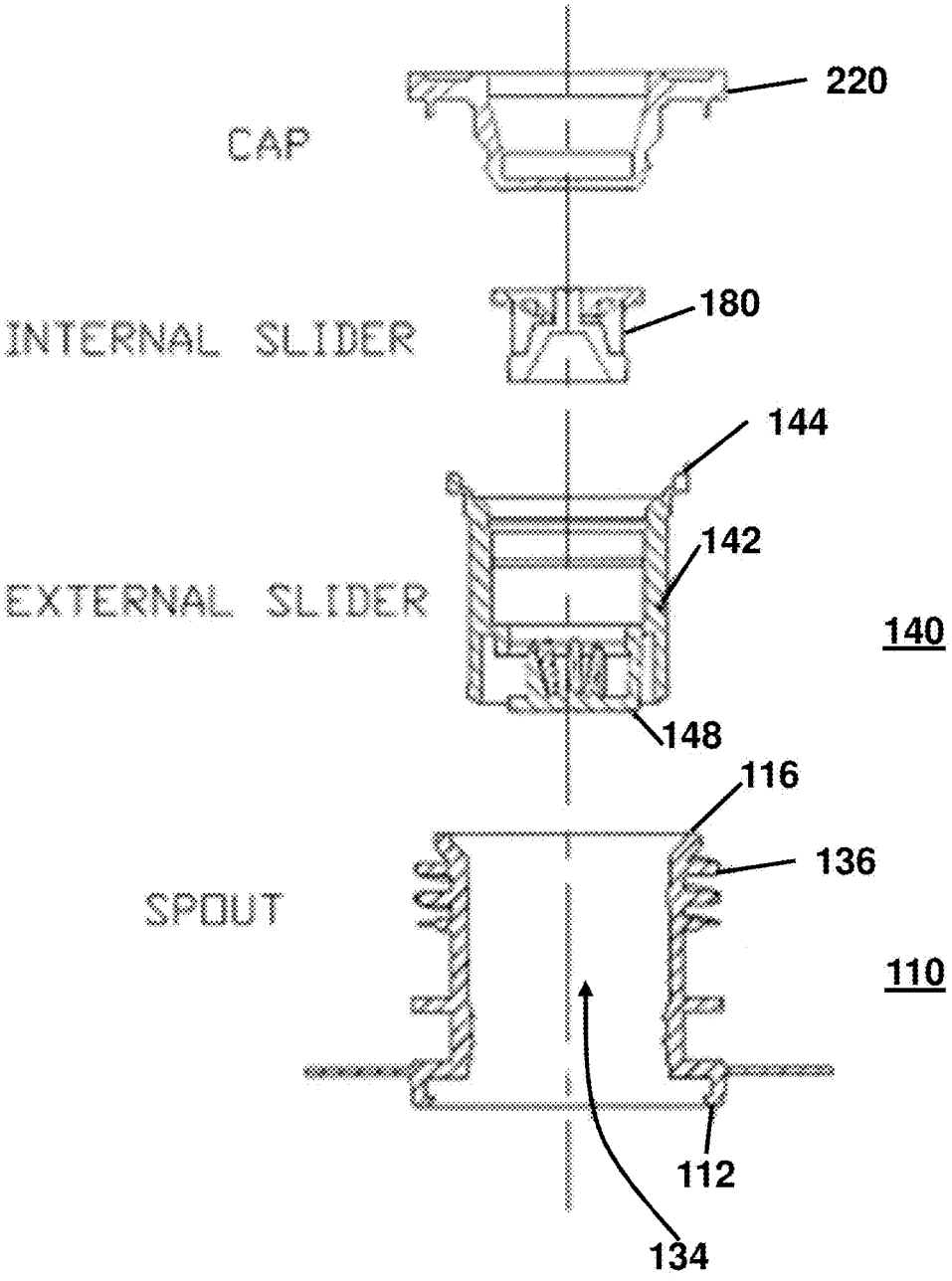
FIG. 5 illustrates an exploded cross-sectional view of a spout assembly according to an aspect of this disclosure.
Figure 6:
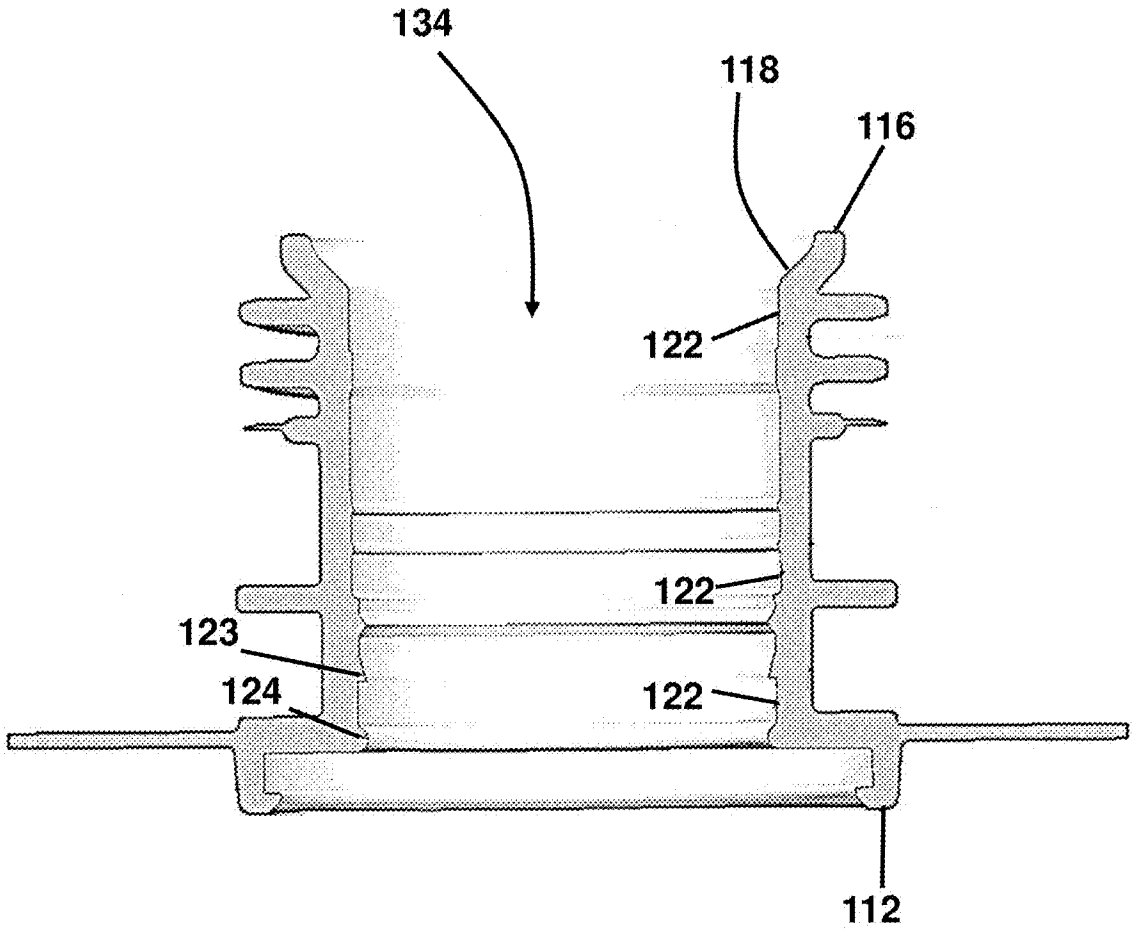
FIG. 6 illustrates a cross-sectional view of a spout according to an aspect.
Figure 8:
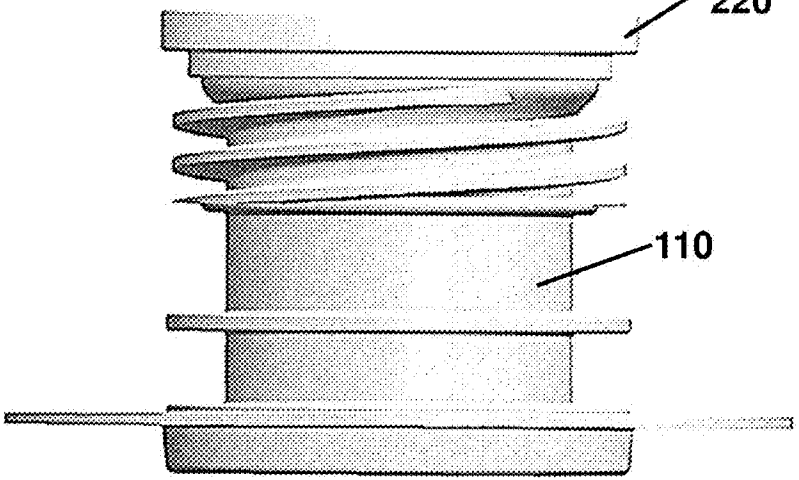
FIG. 8 illustrates a spout assembly in a full-cap position according to an aspect.
Figure 7:
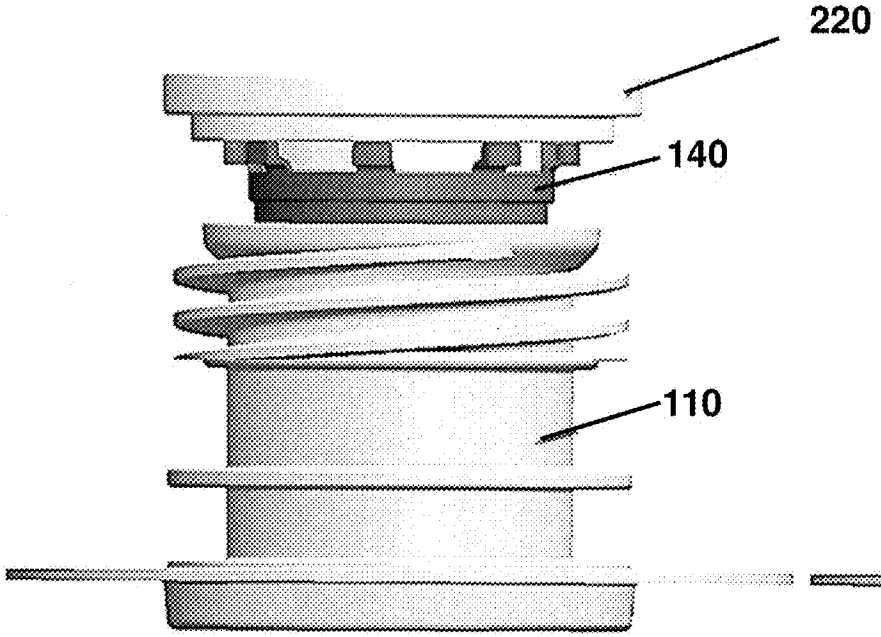
FIG. 7 illustrates a spout assembly in a pre-cap position according to an aspect.
Figure 9:
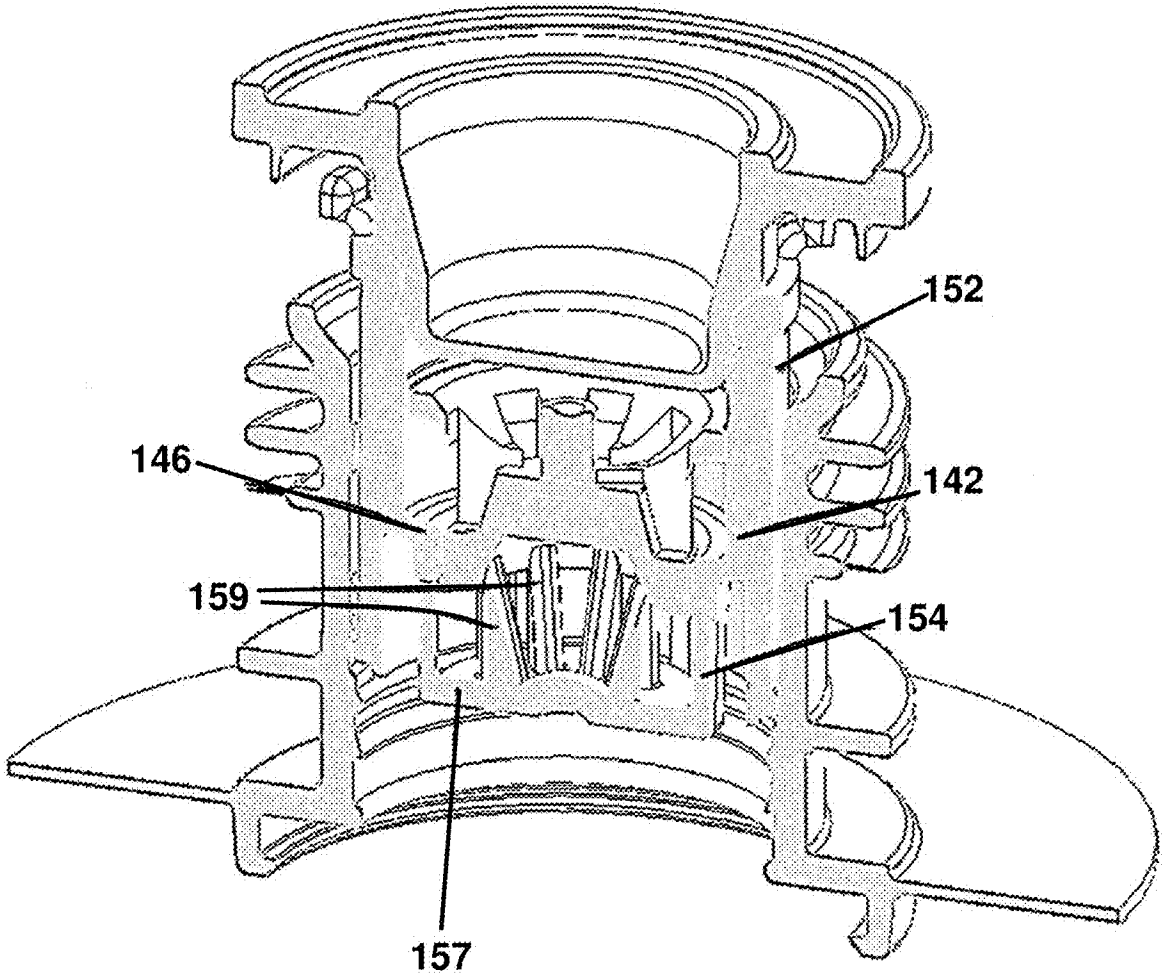
FIG. 9 illustrates an isometric cross-sectional view of a spout assembly in the pre-cap position.
Figure 10:
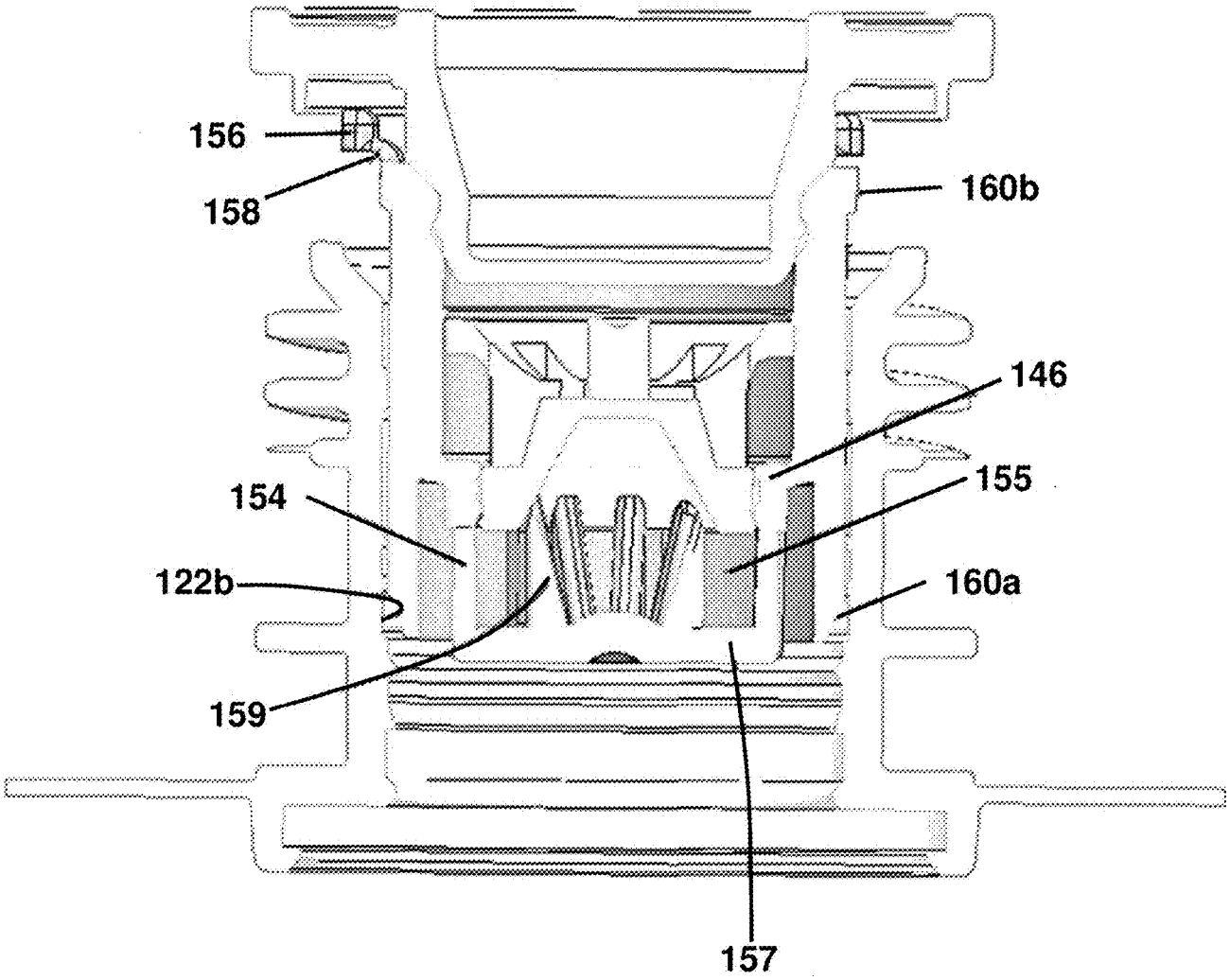
FIG. 10 illustrates a front perspective cross-sectional view of the spout assembly of FIG. 9.
Figure 11:
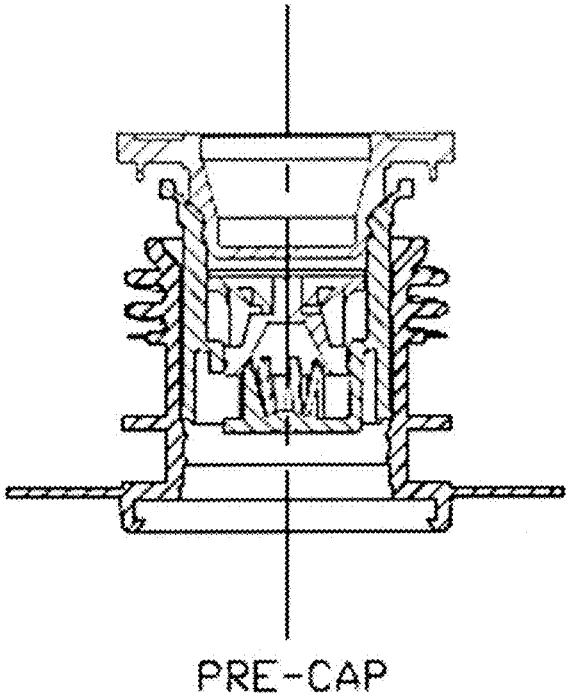
FIG. 11 illustrates a cross-sectional view of a spout assembly in the pre-cap position.
Figure 12:
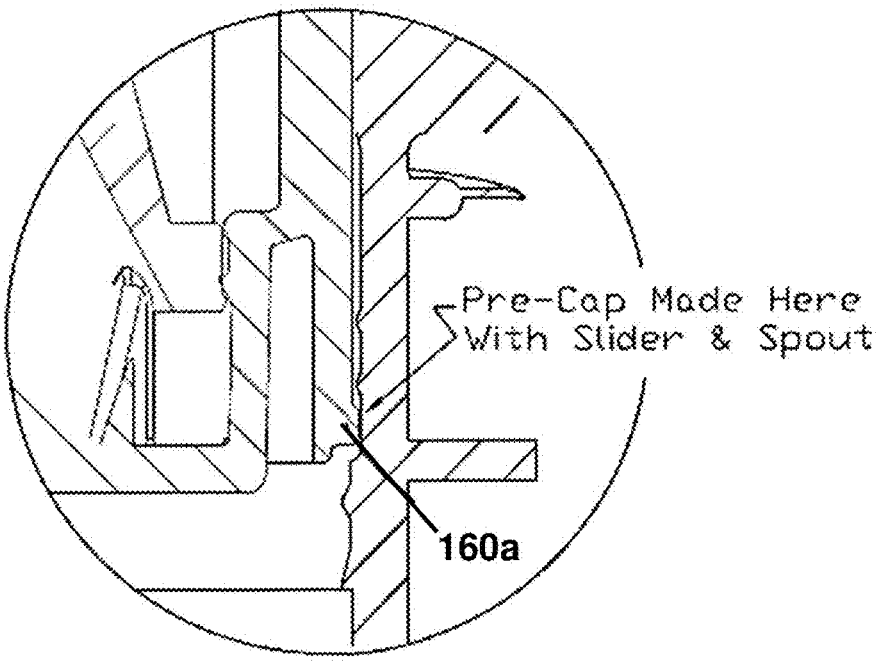
FIG. 12 illustrates an enhanced view of a portion of the spout assembly of FIG. 11.

In a liquid dispensing apparatus such as is used to dispense individual servings of beverages and the like, the syrups, flavorings and other ingredients are frequently supplied in collapsible containers enclosed and shipped within an outer container ("bag-in-box"). The shipping package or container is provided with a fitment that accepts a probe that is part of the dispensing apparatus in order to connect the supply of liquid to the dispensing apparatus. The fitment generally contains a valve that is actuated by the insertion of the probe of the dispensing apparatus in order to allow the liquid to flow into the dispensing apparatus. The fitment attached to the liquid container is generally termed a package connector and the probe or similar device on the dispensing apparatus that interacts with the package connector is generally termed a dispensing connector. Dispensing connectors generally are the quick-connect-disconnect (QCD) type, or the screw-on connector type. The package connector therefore is made compatible to the QCD connector or the screw-on connector.

However, in the present invention, the novel package connector (universal fitment) has the features such that it is compatible with dispensing apparatus that is QCD type, or the screw-on connector type. If a QCD connector is used, a different mechanism is activated, and if a screw-on connector is used, another mechanism is activated for the engaging with the packaging connector to then dispense liquid. Stated another way, this invention relates to liquid dispensing apparatus that functions with either the QCD type of dispensing connector or the screw on connector.

A fitment assembly 100 according to an aspect of the present disclosure may include a spout 110, an external slider 140, and an internal slider 180. In some aspects, the fitment assembly 100 may further include a cap 220. In some aspects, the fitment assembly 100 may also include a collar 240 configured to engage with a screw-on dispensing connector 230.

The spout 110 may be attached to a container 300 that is configured to receive and hold a liquid. The spout 110 may be generally cylindrical, although other cross-sectional shapes may be used depending on the desired dispensing connector that will be utilized with the fitment assembly 100. The spout 110 has a base end 112 and a connection end 116 opposite the base end 112. At the connection end 116, the spout 110 may receive, be inserted into, or other be connected to a dispensing connector 230. At the base end 112, the spout 110 includes a base portion 114 that is connected to a liquid container 300. In some aspects, the liquid container 300 may be a flexible bag or pouch. The container 300 is configured to receive and hold a liquid to be dispensed. In some aspects, the base portion 114 may be a radial flange or another suitable portion of the spout 110 that can be affixed to the container 300. Methods and means for attaching the spout 110 to a wall of the container 300 are known in the art, and a variety of attachment mechanisms may be used to secure the spout 110 to the container 300, such as by heat sealing, adhesives, or other mechanisms.

The spout 110 is substantially hollow and includes an interior surface 118. A spout opening 130 is defined at the connection end 116 of the spout 110 and opposite of the base end 112. A spout passage 134 is defined by the interior surface 118 and extends between the connection end 116 and the base end 112, such that the spout opening 130 is in fluid communication with the passage 134.

The interior surface 118 may define one or more receptacles 122. The receptacle 122 may be a notch, groove, channel, or another indentation that extends radially around the interior surface 118 of the spout 110. The receptacle 122 may extend continuously around the entire circumference of the interior surface 118, or it may be broken up. The receptacle 122 may be an indentation along the interior surface 118, or it may be a channel formed between two walls extending from the interior surface 118. The receptacle 122 can be defined between a first wall 123 and a second wall 124 opposite the first wall 123, such that the receptacle 122 is between the first and second walls 123, 124.

Figure 13:
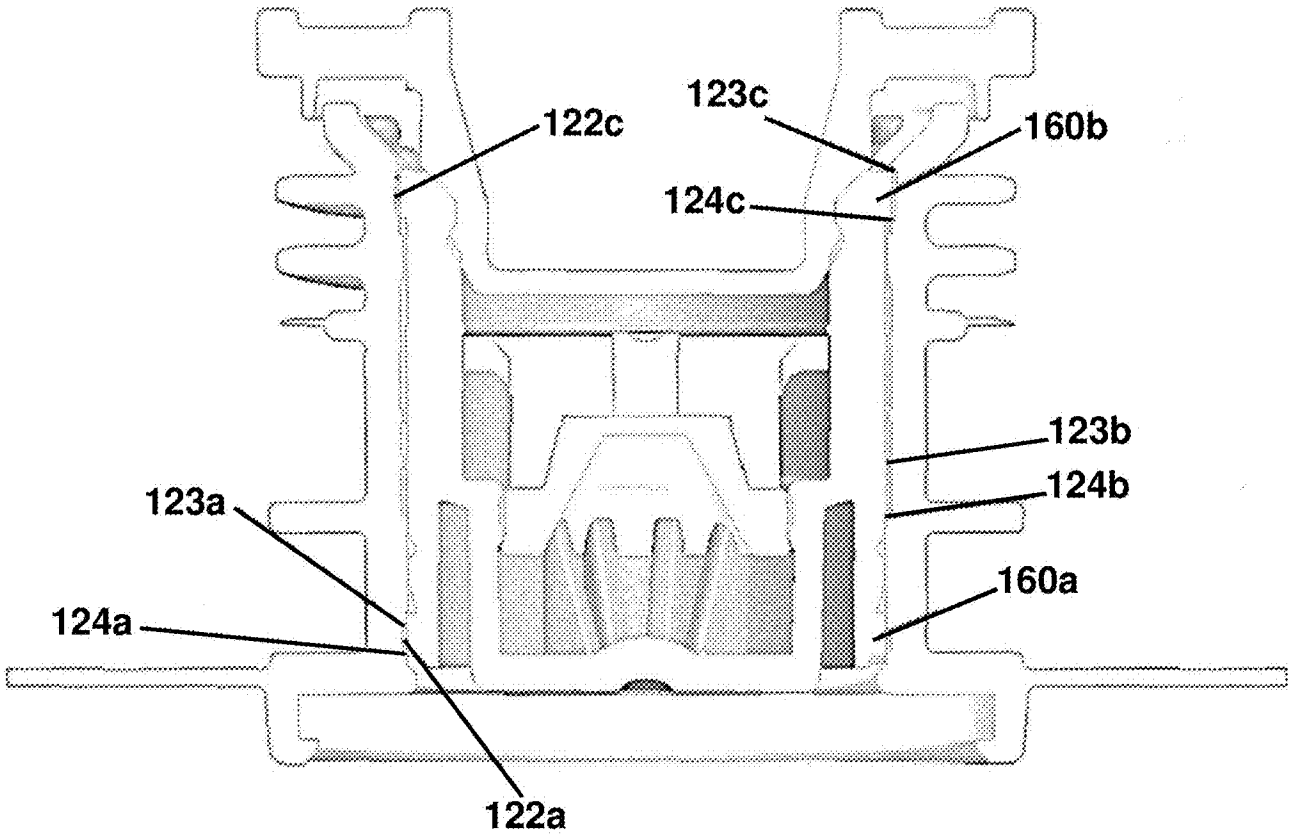
FIG. 13 illustrates a front perspective cross-sectional view of a spout assembly in the full-cap position.
Figure 14:
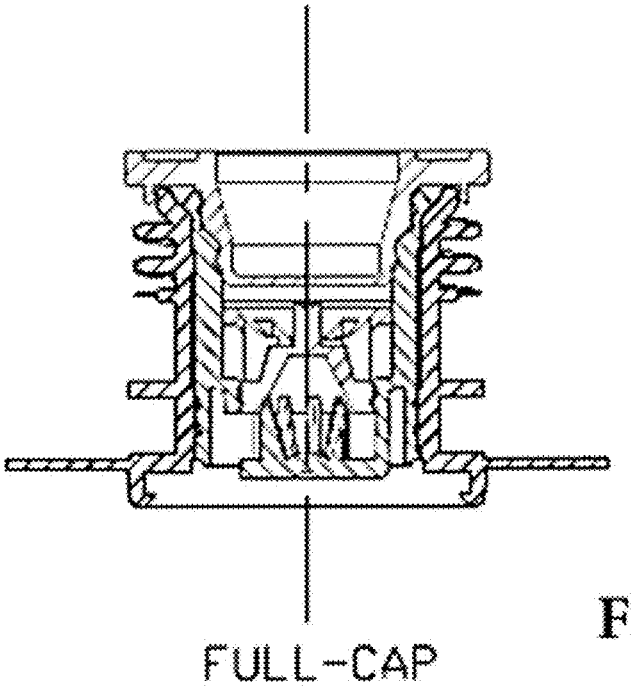
FIG. 14 illustrates another front perspective cross-sectional view of a spout assembly in the full-cap position.
Figure 15:
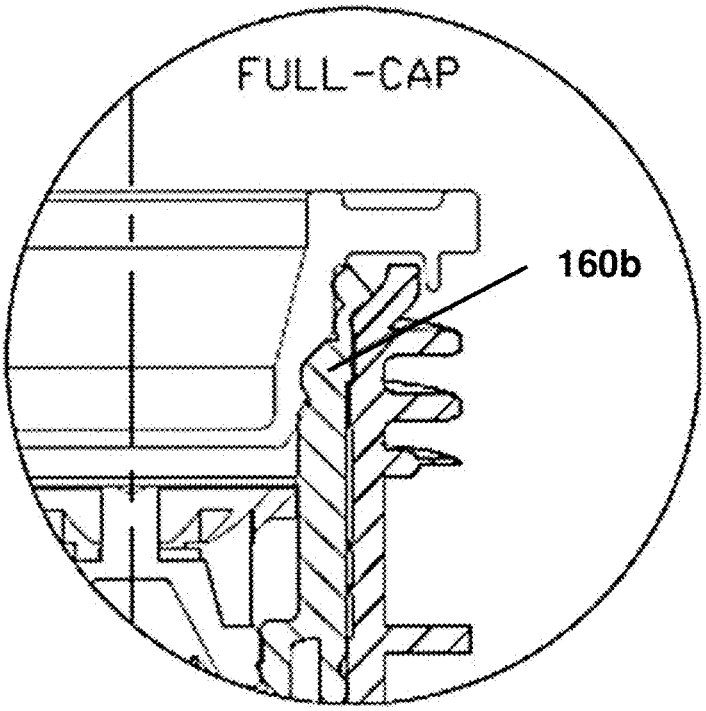
FIG. 15 illustrates an enhanced view of a portion of the spout assembly of FIG. 14.
Figure 16:
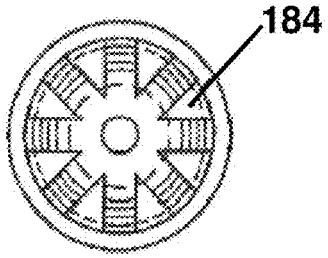
FIG. 16 illustrates a top perspective view of an internal slider according to an aspect.
Figure 17:
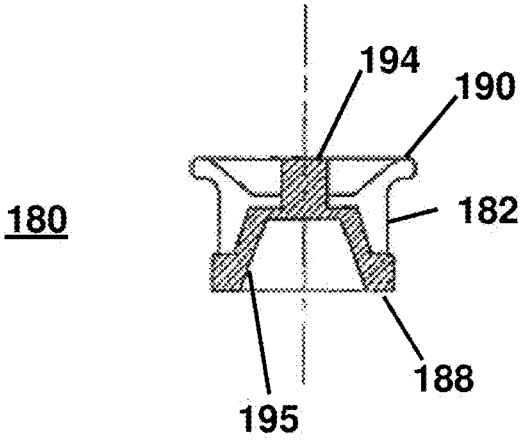
FIG. 17 illustrates a front cross-sectional view of the internal slider of FIG. 16.
Figure 18:
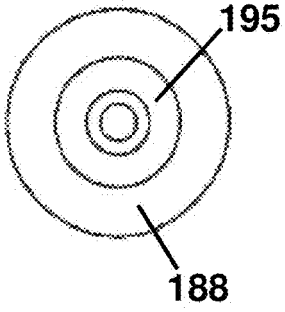
FIG. 18 illustrates a bottom perspective view of the internal slider of FIGS. 16 and 17.
Figure 19:
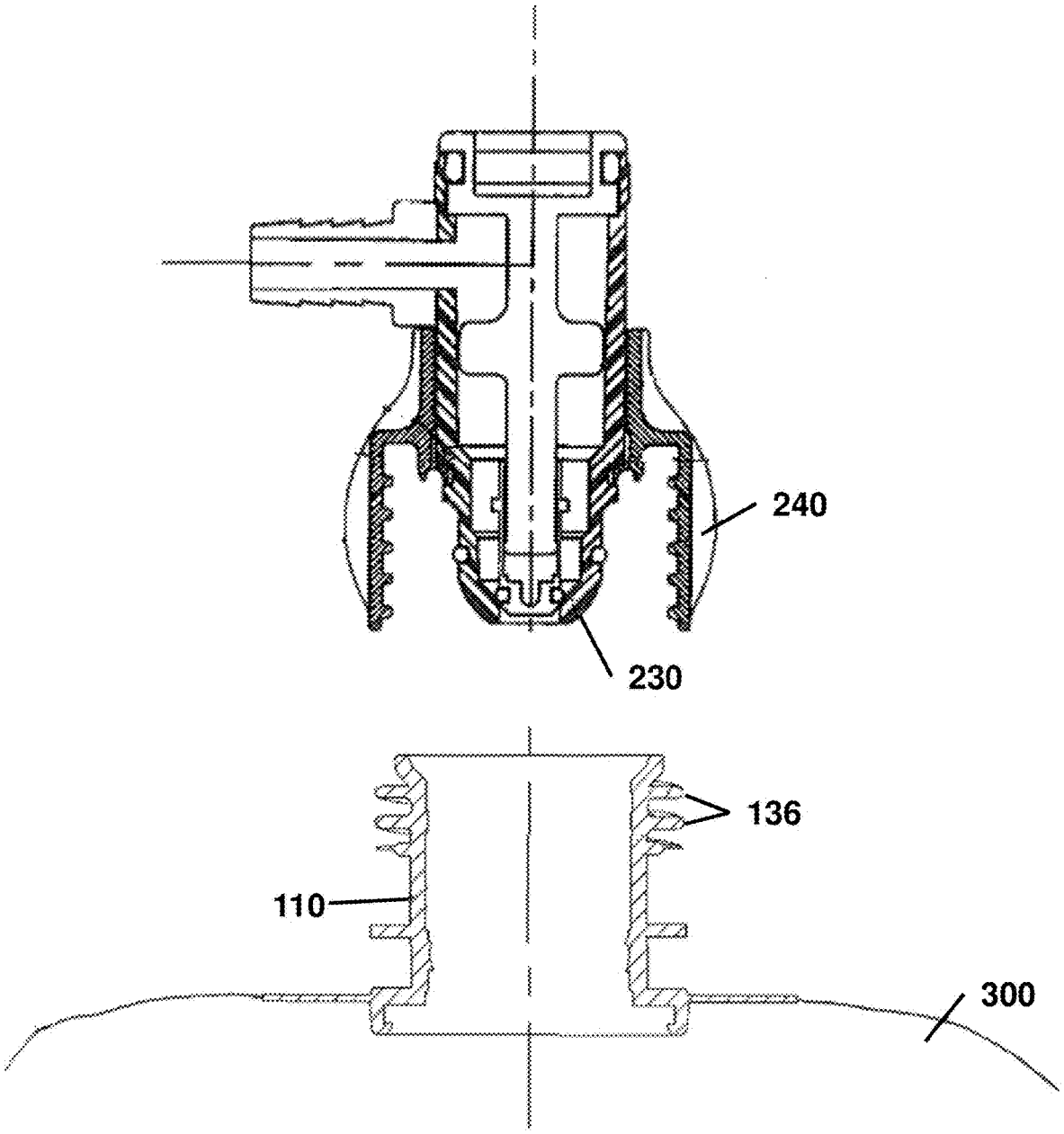
FIG. 19 illustrates a dispensing connector and a spout attached to a container according to an aspect.

In some aspects, a plurality of receptacles 122 may be defined along the interior surface 118. In some aspects, the spout 110 may include a bottom receptacle 122*a*, a middle receptacle 122*b* axially spaced away from the bottom receptacle 122*a*, and a top receptacle 122*c* axially spaced apart from both the bottom receptacle 122*a* and the middle receptacle 122*b*. The middle receptacle 122*b* is disposed between the bottom receptacle 122*a* and the top receptacle 122*c*. The bottom receptacle 122*a* is closer to the base end 112 than are the middle receptacle 122*b* and the top receptacle 122*c*. Each of the plurality of receptacles 122 may include a first wall 123 and a second wall 124. For example, referring to FIG. 13, the bottom receptacle 122*a* may be defined between a first wall 123*a* and a second wall 124*a*; the middle receptacle 122*b* may be defined between a first wall 123*b* and a second wall 124*b*; and the top receptacle 122*c* may be defined between a first wall 123*c* and a second wall 124*c*.

The spout 110 may include a series of external threads 136 or flanges 138, which are adapted to mate with corresponding threads (not shown) on a dispensing apparatus or collar 240. The external surface of the spout 110, specifically the threads 136 and the one or more flanges 138, is not limited by this disclosure and may be altered in accordance with known ways to connect such surfaces, for example, via threads, snap fit, press fit, or another suitable means of engagement with a dispensing connector 230.

Figure 20:
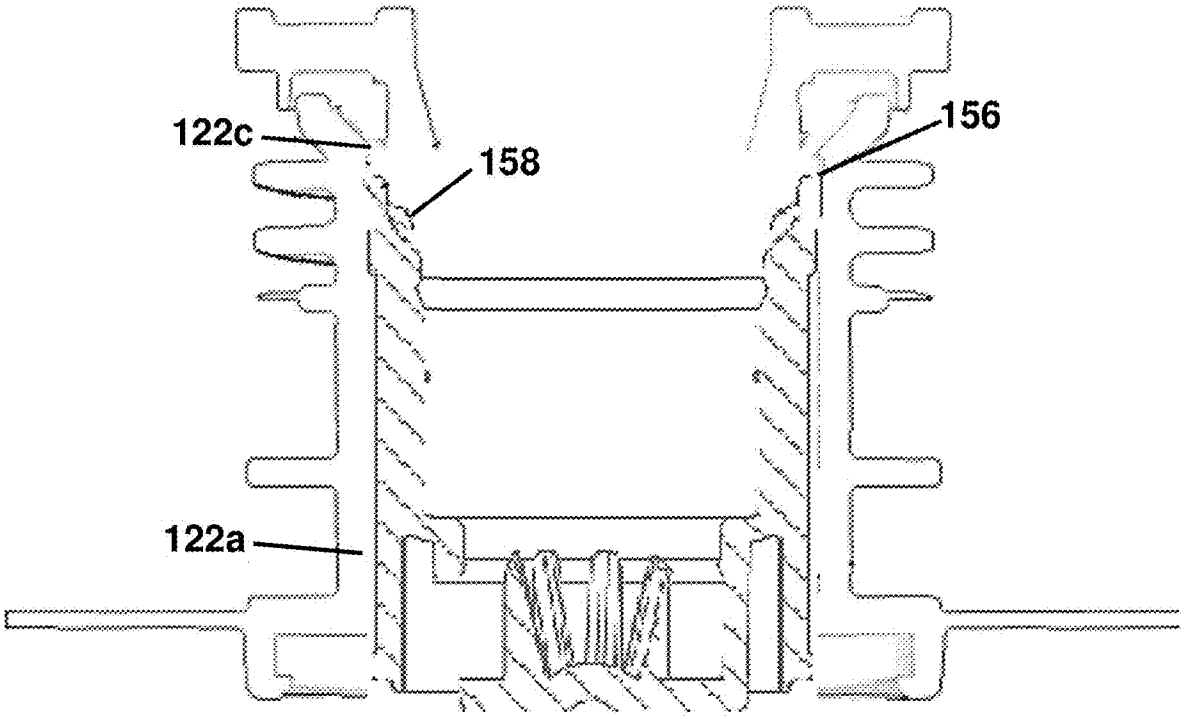
FIG. 20 illustrates a front perspective cross-sectional view of a spout assembly according to another aspect.

An external slider 140 is insertable into the spout 110 and may move axially within the spout passage 134 between the base end 112 and the connection end 116. The external slider 140 may be partially or wholly within the passage 134. The external slider 140 may be generally cylindrically shaped, or it may have a different cross-sectional shape, preferably one that complements the cross section of the spout 110. The external slider 140 has a body 142, which has an exterior surface 152, a top end 144, and a bottom end 148 opposite the top end 144. The top end includes a plurality of flexible tabs 156 that extend away from the top end 144. Each flexible tab 156 is attached to the top end 144 via a neck 158. In some aspects, the flexible tabs 156 may provide engagement with the spout 110 and act as a physical stop or barrier to movement of the external slider 140. For example, as shown in the illustrative aspect of FIG. 20, in some aspects, the external slider 140 is designed to be moved further and deeper into the spout. In such aspects, the flexible tabs 156 may enter the passage 134 and engage with the top receptacle 122*c*. The necks 158 may deform to allow the flexible tabs 156 to slide into the passage 134 and into the top receptacle 122*c*. Once in the top receptacle 122*c*, the flexible tabs 156 provide a physical stop between the external slider 140 and the spout 110. This makes it difficult to move the external slider 140 backwards out of the spout 110. This prevents accidental disconnection of the dispensing components, prevents tampering with the assembly, and prevents used or dirty components from being re-used. This exemplary aspect may occur when the assembly is utilized with a QCD-type connector or another connector that moves the external slider 140 deeper into the spout 110 such that the bottom end 148 is moved past the bottom receptacle 122*a* towards the base end 112 of the spout 110.

Referring to the external slider 140, a projection 146 extends from the body 142 to an interior surface 153. A series of radially spaced posts 154 may extend from the bottom end 148 of the external slider 140. The posts 154 define a plurality of apertures 155 therebetween. The posts 154 support a valve seat 157 at their lower ends. The posts 154 may extend substantially parallel to the body 142 and can be spaced from the body 142 such that liquid may flow between the body 142 and the posts 154 and through the apertures 155 between each post 154. The valve seat 157 may be substantially circular and extend between the lower ends of the spaced posts 154.

The valve seat 157 includes a plurality of spaced projections 159 that extend upwardly from the valve seat 157. The projections 159 may be centrally located on the valve seat 157 and may be radially spaced thereon. The projections 159 are operable to be received in an internal slider 180, as described below. It will be understood by a person skilled in the art that the projections 159 may be spaced in any pattern and may form any shape that performs the same function as the projections 159.

Both the external slider 140 and the internal slider 180 are repeatedly slideable to enable opening and closing of the valve. The internal slider 180 is movable between a closed position that prevents fluid from flowing through the fitment assembly 100 and an open position that allows fluid to flow from the container 300 through the fitment assembly 100. The internal slider 180 is adapted to be moved between the closed and open positions by insertion of the dispensing connector 230 into the external slider 140. The internal slider 180 is sized to be received within the external slider 140. The fitment assembly 100 may include includes a cap 220 configured to engage with the spout 110 at the connection end 116 and/or at the top end 144 of the external slider 140.

The internal slider 180 includes a generally cylindrical body 182 with a base ring 188 that extends around one end of the body 182, and a top ring 190 that extends outwardly from and around the opposing end of the body 182 from the base ring 188. A central post 194 extends away from the body 182 at the opposing end to the base ring 188, and is operable to engage the dispensing connector 230 when the fitment assembly 100 is attached to the dispensing connector 230.

The body 182 of the internal slider 180 is sized to be received within the external slider 140 and is configured to abut the valve seat 157. The top ring 190 is suitably sized to extend beyond the circumference of the body 182 to rest against and abut the projection 146 when the internal slider 180 is in an open position. In the open position, the insertion of the dispensing connector 230 moves the internal slider 180 towards the valve seat 157 and positions the base ring 188 of the body 182 adjacent the valve seat 157. The spaced projections 159 on the valve seat 157 are biased inwardly by internal walls 195 of the body 182 of the internal slider 180. Located on the internal slider 180 are a series of ports 184 that allow the passage of fluid therethrough when the internal slider 180 is in the open position. The ports 184 are disposed between internal walls 195. When in the open position, the ports 184 are in fluid communication with the apertures 155 between the posts 154 of the external slider 140.

In some aspects, the internal walls 195 of the body 182 are sloped inwardly to bias the projections 159 inwardly when the internal slider 180 is located adjacent the valve seat 157. When the dispensing connector 230 is removed, the projections 159 are configured to return to their normally biased positions and flex outwardly. When the projections 159 move outwardly, the internal slider 180 will be forced away from the valve seat 157, and the internal slider 180 will return to the closed position. Other aspects may be used that force the projections 159 to bend away from their normal position upon insertion of the dispensing connector 230 into the fitment assembly 100, provided that when the dispensing connector 230 is removed, the projections 159 force the internal slider 180 away from the valve seat 157 to the closed position.

When the internal slider 180 returns to the closed position, it may return to either its initial position or to one in which the top ring 190 is lower than in the initial position, i.e. closer to the projection 146, provided that there is a seal between the internal slider 180 and the external slider 140 and no fluid can pass through the fitment assembly 100. The closed position referred to includes all such positions in which the internal slider 180 is moved away from the valve seat 157 and where no fluid can pass through the fitment assembly 100.

It will be understood by a person skilled in the art in light of the above description that the external slider 140 is operable to move along the inside of the spout 110 in a smooth telescoping movement while maintaining continuous contact with the interior surface 118 of the spout 110. Likewise, the internal slider 180 is operable to move along the interior surface 153 of the external slider 140 in a smooth telescoping movement. Further, the internal slider 180 may act like a plug within the external slider 140, wherein it is seated within the external slider 140 in the open position to allow fluid to pass through, and is unseated in the closed position to prevent fluid from passing through.

While the projections 159 are biased inwardly and then flex to their initial position, the required inherent resilience is fairly limited, and all parts of the fitment assembly 100 may be formed of a fairly rigid material.

Although the fitment assembly 100 of the present disclosure may be made of any material having suitable properties, it is preferably made of a synthetic resin material that can be melded to form its parts. The synthetic resin material must have sufficient resiliency so that the projections 159 will return to their rest position when a deforming pressure is released. If the fitment assembly 100 is made from a single synthetic resin material, recycling of the valve is made particularly easy because the used valve can be ground up, re-melted, and remolded into new valves. It is preferred that the fitment assembly 100 be made from a synthetic resin that is the same as that used to form the liquid-containing bag with which the fitment is used. Such compatibility further increases the ease of recycling the valve. A preferred synthetic resin for the valve is polypropylene. The valve can also be made of high-density polyethylene, polystyrene, nylon or the like.

The exterior surface 152 of the external slider 140 includes at least one locking ridge 160. The locking ridge 160 may be a locking bead, a stop ring, or another protrusion extending radially away from the exterior surface 152. The locking ridge 160 may extend continuously around the entire circumference of the exterior surface 152, or it may be broken up. In some aspects, a plurality of locking ridges 160 may be defined along the exterior surface 152. In some aspects, the external slider 140 may include a bottom locking ridge 160*a* and a top locking ridge 160*b* axially spaced apart from the bottom locking ridge 160*a*. In some aspects, the flexible tabs 156 may be used as, and may have similar structural and functional features as, a locking ridge 160.

The one or more locking ridges 160 on the external slider 140 may be configured to releasably engage with the one or more receptacles 122 on the interior of the spout 110. The external slider 140 may be configured to be positioned within the spout 110 within multiple configurations. In a first configuration, the external slider 140 may be axially spaced within the passage 134 such that the bottom locking ridge 160*a* is engaged with the middle receptacle 122*b*. This may be referred to as a "pre-cap" configuration. This configuration may be utilized when the assembly is used to introduce flowable material into the container or bag. 300. In the pre-cap configuration, the external slider 140 and the internal slider 180 are configured to be removed from the passage 134 of the spout 110 to allow a filling component to introduce the flowable material into the container 300 through the spout 110. In some aspects, the external slider 140 may be releasably affixed to the cap 220. In operation, a user may grasp the external slider 140, the internal slider 180, or the cap 220 to remove the components out of the passage 134. In some preferred aspects, the user or a filling robot may grip the cap 220 and remove from the spout 110 the cap 220 and the external slider 140 that is attached thereto, as well as the internal slider 180 that is within the external slider 140.

After the container or bag 300 has been filled, the external slider 140 and the internal slider 180 are re-inserted into the passage 134 and moved into a second configuration that may be referred to as a "full-cap" configuration. The cap 220 may optionally be included in this configuration. In the second configuration, the external slider 140 may be axially spaced within the passage 134 such that the bottom locking ridge 160*a* is engaged with the bottom receptacle 122*a*. In the full-cap configuration, the external slider 140 is disposed closer to the base end 112 of the spout 110 than in the pre-cap configuration. In some aspects, it may be preferable that when the assembly is in the full-cap configuration that it is prevented from being moved back to the pre-cap configuration or being otherwise disassembled. It will be appreciated that any components can physically be taken apart, but within the context of this disclosure, "not disassembled" should be construed as not being intended to be easily disassembled, for example, without applying excessive force, using tools, and/or damaging the components involved.

In the full-cap configuration, the top locking ridge 160*b* may be engaged with the top receptacle 122*c* of the spout 110. This may help keep the external slider 140 (and the internal slider 180 therein) in the desired position and orientation within the passage 134. Referring again to FIG. 20 and above description, in some aspects, the external slider 140 in the full-cap configuration may be pushed further into the spout 110 such that the bottom end 148 of the external slider 140 slides over and past the second wall 124 of the bottom receptacle 122*a*. In such aspects, the flexible tabs 156 may be engaged with the top receptacle 122*c* instead of the top locking ridge 160*b*.

The engagement of the external slider 140 with the spout 110 during the pre-cap configuration allows for the cap 220 to not need a skirt. In existing technologies, a cap has a radially larger size and includes a skirt that extends around the spout. The skirt of the cap engages with the spout and helps orient and position the components for the preferred pre-cap and/or full-cap configuration. The placement of the cap in these existing options, however, limits the available sizes of the threading and/or flanges on the exterior of the spout (i.e. the thread height or the radial distance a flange projects from the spout). For example, if larger threads or flanges are needed, they would abut or interfere with the skirt of the cap. Thus, spouts with only small ranges of thread or flange sizes could be manufactured, limiting the ability to use such spouts with many existing connectors and/or dispensers that required differently sized threads or flanges. In these existing technologies, the cap could not simply be excluded because the cap was necessary to engage with the spout to form the pre-cap and/or full-cap configurations. The aspects disclosed throughout this application are structurally different to allow the cap to be smaller and to not require a skirt. Unlike the existing technology, the pre-cap and the full-cap configurations are established by the structural components that are in the interior of the spout 110 or otherwise present inside the passage 134 during operation. By not having the necessary components on the outside of the spout, different threads and/or flanges may be used, including larger sized threads and/or flanges that can be utilized with many existing dispensers and/or fillers, thus making the presently disclosed aspects more universally applicable than prior technology. Moreover, such structures allow for the passage 134 of the spout 110 to be conical or frustoconical inside the spout 110, wherein the passage 134 tapers from the connection end 116 to the base end 112. Furthermore, this allows for fewer protrusions, flanges, and other obstructions necessary in existing technology for engaging the cap to move the assembly to a pre-cap or a full-cap configuration. Fewer components allow for less material to be used, and result in smaller fitments.

In existing technology, sometimes the dispensing connector engages the spout 110 without entering the spout 110 deep enough. To complete engagement, the dispensing connector often has to be forcefully moved further down into existing fitments, thus causing damage to the spout and/or other components of the assembly. In the present assemblies, the dispensing connector does not need to penetrate as deeply into the spout 110 as in the previous existing fitments, so less unwanted force is applied to the spout 110, resulting in better engagement, less leaking of the liquid due to poor connections, less damage to the fitment, and decreased frequency of replacements.

While systems and methods have been described in connection with the various embodiments of the various figures, it will be appreciated by those skilled in the art that changes could be made to the embodiments without departing from the broad inventive concept thereof. It is understood, therefore, that this disclosure is not limited to the particular embodiments disclosed, and it is intended to cover modifications within the spirit and scope of the present disclosure as defined by the claims.

What is claimed:

1. A dispensing assembly comprising:

a spout defining an internal surface and a passage therethough, the spout having (i) a first receptacle defined on the interior surface, (ii) a second receptacle axially spaced away from the first receptacle, and (iii) a third receptacle axially spaced away from the first and second receptacles;

a first slider insertable into the spout, the first slider having an external surface that defines a first locking ridge configured to releasably engage with the first receptacle, the first slider further including a second locking ridge axially spaced from the first locking ridge; and a second slider insertable into the first slider, wherein the first slider is configured to move within the spout and is configured to have a first configuration and a second configuration different from the first configuration, and when the first slider is in the first configuration, the first locking ridge is engaged with the first receptacle, and when the first slider is in the second configuration, the first locking ridge is engaged with the second receptacle and the second locking ridge is engaged with the third receptacle.

2. The dispensing assembly of claim 1, wherein the passage is frustoconical.

3. The dispensing assembly of claim 1, further configured to releasably engage with a dispenser connector, such that the dispensing connector and the spout are in fluid communication.

4. The dispensing assembly of claim 1, wherein the second slider is movable between a closed position operable to prevent the flow of fluid through the dispensing assembly and an open position operable to allow the flow of fluid through the dispensing assembly, and wherein the second slider is biased toward the closed position.

5. The dispensing assembly of claim 4, wherein the second slider is movable between the closed and the open positions by insertion of a dispensing connector into the first slider adjacent the second slider when the dispensing assembly is in the second configuration.

6. A dispensing system for dispensing flowable material, the dispensing system comprising:

a spout defining an internal surface and a passage therethrough, the spout having a first receptacle defined on the interior surface and a second receptacle defined on the interior surface spaced away from the first receptacle;

a first slider insertable into the spout, the first slider having an external surface that defines a first locking ridge configured to releasably engage with the first receptacle and a second locking ridge configured to engage with the second receptacle and further comprising a third locking ridge disposed thereon;

a second slider insertable into the first slider and being movable between a closed position operable to prevent the flowable material from passing through the dispensing assembly and an open position operable to allow the flowable material to pass through the dispensing assembly; and a dispensing connector configured to releasably engage with the second slider and to move the second slider from the closed position to the open position, wherein the first slider is configured to move within the spout and is configured to have a first configuration and a second configuration different from the first configuration, and wherein when the dispensing connector is not engaged with the second slider, the first locking ridge is engaged with the first receptacle and the second locking ridge is engaged with the second receptacle, and when the dispensing connector is engaged with the second slider, the first locking ridge is not engaged with the first receptacle, the second locking ridge is not engaged with the second receptacle, and the third locking ridge is engaged with the second receptacle.

7. The dispensing system of claim 6, wherein both, when the dispensing connector is not engaged with the second slider and when the dispensing connector is engaged with the second slider, the first locking ridge is engaged with the first receptacle and the second locking ridge is engaged with the second receptacle.

8. The dispensing system of claim 6, further comprising a collar on the dispensing connector, the collar having internal threads and configured to engage with external threads defined on the spout.

9. The dispensing system of claim 6, wherein the passage is frustoconical, and the dispensing connector defines a shape complementary to the passage, such that when the dispensing connector is engaged with the second slider, a fluid-tight seal is formed between the dispensing connector and the first slider.

10. The dispensing system of claim 6, further comprising a container configured to receive the flowable material, the container being fixedly attached to the spout.

11. The dispensing system of claim 10, wherein the flowable material is configured to be moved from the container through the spout and into the dispensing connector, or from the dispensing connector through the spout into the container.

* * * * *